US008523637B2

(12) United States Patent
Loveless et al.

(10) Patent No.: US 8,523,637 B2
(45) Date of Patent: Sep. 3, 2013

(54) ANGLE GRINDER DUST SHROUD WITH SLIDEABLE ACCESS HATCH

(75) Inventors: Spencer Loveless, Price, UT (US); Kyle Alan Bjork, Buffalo, MN (US); Darren Diess, Temecula, CA (US)

(73) Assignee: Dustless Depot, LLC, Price, UT (US)

( * ) Notice: Subject to any disclaimer, the term of this patent is extended or adjusted under 35 U.S.C. 154(b) by 524 days.

(21) Appl. No.: 12/839,270

(22) Filed: Jul. 19, 2010

(65) Prior Publication Data

US 2011/0021121 A1 Jan. 27, 2011

Related U.S. Application Data

(60) Provisional application No. 61/227,178, filed on Jul. 21, 2009.

(51) Int. Cl.
*B24B 23/02* (2006.01)
*B24B 55/05* (2006.01)

(52) U.S. Cl.
USPC ..... 451/359; 451/356; 451/452; 451/456

(58) Field of Classification Search
USPC ..... 30/124, 151; 83/100; 451/354, 451/356, 357, 358, 359, 452, 456, 457
See application file for complete search history.

(56) References Cited

U.S. PATENT DOCUMENTS

| | | | |
|---|---|---|---|
| 907,734 | A | 12/1908 | Butterfield |
| 1,123,562 | A | 1/1915 | Lund |
| RE15,262 | E | 1/1922 | Gurgel |
| 1,643,882 | A | 9/1927 | Faiver |
| 2,032,382 | A | 3/1936 | Torrison |
| 2,041,689 | A | 5/1936 | Baumeister et al. |
| 2,279,186 | A | 4/1942 | Terry et al. |
| 2,291,269 | A | 7/1942 | Wiggleworth |
| 2,294,272 | A | 8/1942 | Boice |
| 2,384,688 | A | 9/1945 | Morris |
| 2,503,854 | A | 4/1950 | Trainor |
| 2,520,725 | A | 8/1950 | Judd |
| 2,803,098 | A | 8/1957 | Robert et al. |
| 2,819,570 | A | 1/1958 | Guilbert et al. |
| 2,819,571 | A | 1/1958 | Morgan |
| 2,994,995 | A | 8/1961 | Griffith |
| 3,166,877 | A | 1/1965 | Reames |
| 3,256,648 | A | 6/1966 | Subonovich |
| 3,468,076 | A | 9/1969 | Jones |

(Continued)

FOREIGN PATENT DOCUMENTS

| | | |
|---|---|---|
| EP | 556713 | 8/1993 |
| EP | 0 579 964 | 1/1994 |

(Continued)

OTHER PUBLICATIONS

Declaration re Hilti Shroud—available Circa 2006.

*Primary Examiner* — Timothy V Eley
(74) *Attorney, Agent, or Firm* — Brett Peterson; Pate Peterson PLLC

(57) ABSTRACT

A dust shroud for an angle grinder includes an access hatch which slides along the shroud body to selectively expose an edge of a grinding disc to allow grinding into a corner. The hatch remains attached to the shroud body in both the open and closed position, making the hatch easier to use and less likely to become lost, resulting in increased worker compliance in properly using the hatch.

19 Claims, 6 Drawing Sheets

(56) References Cited

U.S. PATENT DOCUMENTS

| | | | | |
|---|---|---|---|---|
| 3,667,170 | A | 6/1972 | MacKay | |
| 3,673,744 | A | 7/1972 | Oimoen | |
| 3,835,543 | A | 9/1974 | Polydoris et al. | |
| 3,848,686 | A | 11/1974 | Jysky et al. | |
| 3,862,521 | A | 1/1975 | Isaksson | |
| 3,882,598 | A | 5/1975 | Earle et al. | |
| 3,882,644 | A | 5/1975 | Cusumano | |
| 3,945,281 | A | 3/1976 | Kreitz | |
| 3,987,589 | A * | 10/1976 | Marton | 451/359 |
| 4,063,478 | A | 12/1977 | Stuy | |
| 4,090,297 | A | 5/1978 | Wanner | |
| 4,135,334 | A | 1/1979 | Rudiger | |
| 4,201,256 | A | 5/1980 | Truhan | |
| 4,253,362 | A | 3/1981 | Olson | |
| 4,326,864 | A | 4/1982 | Sittler | |
| 4,367,665 | A | 1/1983 | Terpstra et al. | |
| 4,381,628 | A | 5/1983 | Dicke | |
| 4,400,995 | A | 8/1983 | Palm | |
| 4,574,532 | A | 3/1986 | Haberle et al. | |
| 4,576,072 | A | 3/1986 | Terpstra et al. | |
| 4,622,782 | A | 11/1986 | Roestenberg | |
| 4,697,389 | A | 10/1987 | Romine | |
| 4,761,877 | A | 8/1988 | Rupp | |
| 4,782,632 | A | 11/1988 | Matechuk | |
| 4,868,949 | A | 9/1989 | Loveless et al. | |
| 4,921,375 | A | 5/1990 | Famulari | |
| 4,932,163 | A | 6/1990 | Chilton et al. | |
| 4,932,164 | A | 6/1990 | Sullivan et al. | |
| 5,033,552 | A | 7/1991 | Hu | |
| 5,074,044 | A | 12/1991 | Duncan et al. | |
| 5,084,972 | A | 2/1992 | Waugh | |
| 5,105,585 | A | 4/1992 | Hampl et al. | |
| 5,125,190 | A | 6/1992 | Buser et al. | |
| 5,131,192 | A | 7/1992 | Cheng | |
| 5,163,252 | A | 11/1992 | Garner et al. | |
| 5,167,215 | A * | 12/1992 | Harding, Jr. | 125/13.01 |
| 5,176,408 | A | 1/1993 | Pedersen | |
| 5,201,785 | A | 4/1993 | Nagano | |
| 5,237,781 | A | 8/1993 | Demetrius | |
| 5,327,649 | A | 7/1994 | Skinner | |
| 5,339,571 | A | 8/1994 | Timmons et al. | |
| 5,411,433 | A | 5/1995 | Keller | |
| 5,435,066 | A | 7/1995 | Bare | |
| 5,440,809 | A | 8/1995 | Padilla | |
| 5,445,056 | A | 8/1995 | Folci | |
| 5,545,082 | A | 8/1996 | Courson et al. | |
| 5,558,571 | A | 9/1996 | Toyoshima et al. | |
| 5,564,408 | A | 10/1996 | Bassols | |
| 5,566,457 | A | 10/1996 | Batschari et al. | |
| 5,575,035 | A | 11/1996 | Reis et al. | |
| 5,582,225 | A | 12/1996 | Schank | |
| 5,588,213 | A | 12/1996 | Swanberg | |
| 5,609,516 | A | 3/1997 | Courson et al. | |
| 5,653,561 | A | 8/1997 | May | |
| 5,675,895 | A | 10/1997 | Mori et al. | |
| 5,688,082 | A | 11/1997 | Richardson | |
| 5,704,956 | A | 1/1998 | Loveless et al. | |
| 5,713,785 | A | 2/1998 | Nishio | |
| D392,531 | S | 3/1998 | Richardson | |
| 5,774,992 | A | 7/1998 | Lindenmuth | |
| 5,791,979 | A | 8/1998 | Duncan et al. | |
| 5,816,733 | A | 10/1998 | Ishikawa et al. | |
| 5,819,619 | A | 10/1998 | Miller et al. | |
| 5,931,072 | A | 8/1999 | Shibata | |
| 5,954,863 | A | 9/1999 | Loveless et al. | |
| 6,027,399 | A | 2/2000 | Stewart | |
| 6,053,674 | A | 4/2000 | Thompson | |
| 6,108,912 | A | 8/2000 | Radigan | |
| 6,138,317 | A | 10/2000 | Holmes et al. | |
| 6,167,626 | B1 | 1/2001 | Doumani et al. | |
| 6,183,527 | B1 | 2/2001 | O'Banion et al. | |
| 6,219,922 | B1 | 4/2001 | Campbell et al. | |
| 6,273,081 | B1 | 8/2001 | Gorgol et al. | |
| 6,318,352 | B1 | 11/2001 | Gnazzo et al. | |
| 6,347,985 | B1 | 2/2002 | Loveless | |
| 6,470,778 | B1 | 10/2002 | Kaye, Jr. et al. | |
| 6,471,574 | B1 | 10/2002 | Rupprecht et al. | |
| 6,557,261 | B1 | 5/2003 | Buser et al. | |
| 6,648,742 | B1 | 11/2003 | Segiel, Jr. | |
| 6,679,145 | B1 | 1/2004 | Lee | |
| 6,699,114 | B1 | 3/2004 | Booeshaghi et al. | |
| 6,726,554 | B1 | 4/2004 | Chen et al. | |
| 6,748,660 | B2 | 6/2004 | Buser et al. | |
| 6,796,208 | B1 | 9/2004 | Jorgensen | |
| 6,811,476 | B2 | 11/2004 | Ohlendorf | |
| 6,823,907 | B2 | 11/2004 | Cheng | |
| 6,860,799 | B2 | 3/2005 | Loveless | |
| 6,878,050 | B2 | 4/2005 | Wendt et al. | |
| 6,896,605 | B2 * | 5/2005 | Ohlendorf | 451/454 |
| 6,902,594 | B2 | 6/2005 | Cho | |
| 6,935,939 | B1 | 8/2005 | Buser et al. | |
| 6,948,412 | B2 | 9/2005 | Brazell et al. | |
| 6,960,124 | B2 | 11/2005 | Lee | |
| 7,013,884 | B2 | 3/2006 | Guth | |
| 7,044,039 | B2 | 5/2006 | Powell | |
| 7,044,843 | B1 | 5/2006 | Lin | |
| 7,047,647 | B1 | 5/2006 | Muller | |
| 7,047,650 | B2 | 5/2006 | Chen | |
| 7,069,831 | B2 | 7/2006 | Chang | |
| 7,171,880 | B2 | 2/2007 | Powell | |
| 7,195,429 | B2 | 3/2007 | Dods et al. | |
| 7,197,826 | B2 | 4/2007 | Baxivanelis | |
| 7,198,559 | B2 | 4/2007 | Walstrum et al. | |
| 7,204,178 | B2 | 4/2007 | Bergmann | |
| 7,216,572 | B2 | 5/2007 | Keenan | |
| 7,222,560 | B2 * | 5/2007 | Parks et al. | 83/165 |
| 7,223,161 | B2 | 5/2007 | Kodani et al. | |
| 7,300,337 | B1 | 11/2007 | Sun et al. | |
| 7,438,633 | B2 * | 10/2008 | Jespersen | 451/350 |
| 7,578,063 | B2 | 8/2009 | Martin | |
| 7,625,265 | B2 | 12/2009 | Woods et al. | |
| 7,635,293 | B2 | 12/2009 | Sun et al. | |
| 7,661,195 | B1 | 2/2010 | Wood | |
| 7,740,086 | B2 | 6/2010 | Bleicher et al. | |
| 7,887,624 | B2 | 2/2011 | Ekstrom et al. | |
| 7,892,075 | B2 | 2/2011 | Esenwein | |
| 7,985,042 | B1 | 7/2011 | Paxton | |
| 2004/0206220 | A1 | 10/2004 | Keenan | |
| 2005/0088866 | A1 | 4/2005 | Levine | |
| 2005/0155233 | A1 | 7/2005 | Chen | |
| 2006/0005681 | A1 | 1/2006 | Lambert et al. | |
| 2006/0019585 | A1 | 1/2006 | Zayat | |
| 2007/0079589 | A1 | 4/2007 | Ekstrom et al. | |
| 2007/0155296 | A1 | 7/2007 | Hofmann et al. | |
| 2007/0178815 | A1 | 8/2007 | Buser | |
| 2007/0193759 | A1 | 8/2007 | Sweig et al. | |
| 2007/0251104 | A1 | 11/2007 | Heinrichs | |
| 2008/0060631 | A1 | 3/2008 | Dofher | |
| 2008/0099053 | A1 | 5/2008 | Loveless | |
| 2008/0109986 | A1 | 5/2008 | Loveless | |
| 2008/0163492 | A1 | 7/2008 | Johansson | |
| 2008/0200103 | A1 | 8/2008 | Esenwein | |
| 2008/0271323 | A1 | 11/2008 | Perlmutter | |
| 2009/0181604 | A1 | 7/2009 | Loveless | |
| 2009/0181605 | A1 | 7/2009 | Loveless | |
| 2009/0181606 | A1 | 7/2009 | Loveless | |
| 2009/0183377 | A1 | 7/2009 | Loveless | |
| 2009/0183800 | A1 | 7/2009 | Loveless | |
| 2009/0186559 | A1 | 7/2009 | Loveless | |
| 2009/0311953 | A1 | 12/2009 | Maute et al. | |

FOREIGN PATENT DOCUMENTS

| | | |
|---|---|---|
| GB | 2 260 721 | 4/1993 |
| GB | 2262159 A | 6/1993 |
| JP | 10-000559 | 1/1998 |
| JP | 10015717 A | 1/1998 |
| JP | 2001096525 A | 4/2001 |
| KR | 10-2002-0056086 | 7/2002 |
| WO | WO 9944786 A1 | 9/1999 |

* cited by examiner

ANGLE GRINDER DUST SHROUD WITH SLIDEABLE ACCESS HATCH

PRIORITY

The present application claims the benefit of U.S. Provisional Application Ser. No. 61/227,178, filed Jul. 21, 2009, which is herein incorporated by reference in its entirety.

THE FIELD OF THE INVENTION

The present invention relates to dust shrouds. More specifically, the present invention relates to a dust shroud for an angle grinder with contains a slideable access hatch to allow for grinding with the edge of the grinding disc.

BACKGROUND

Angle grinders are commonly used for grinding cement or other similar tasks. Without a dust shroud, debris is scattered over a wide area. It is desirable to contain the dust which is created for several reasons. It is desirable to contain the dust and debris to keep the workplace cleaner and to minimize the time necessary to clean up afterwards. While grinding cement, for example, fine dust is often created which spreads a large distance and can be quite difficult to clean up afterwards. It is also desirable to contain the dust and debris to keep the same from getting into the tool itself, causing premature failure of the bearings, motor, etc. Additionally, debris such as concrete dust poses a health risk to the machine operator and others who may breathe it. It is thus desirable to collect the dust to minimize any exposure to the dust.

Dust shrouds are often used to both contain grinding dust and prevent a mess as well as to protect an operator from debris and dust. Additionally, the dust shroud should protect the operator from contact with the grinding disc. These shrouds generally attach to an angle grinder between the grinder body and the grinding disc, typically to a cylindrical collar formed around the grinder output shaft. The shroud then forms a barrier between the operator and the grinding disc. The shroud often extends around the edges of the grinding disc, leaving the bottom grinding portion open for use. Thus, the dust shroud provides a dust and debris barrier and a safety barrier.

Many dust shrouds provide a vacuum port so that a vacuum may be used to suction dust and debris out of the shroud. This avoids airborne dust and debris that can lead to such health problems as silicosis. The use of a vacuum also keeps the workplace clean of debris, dramatically reducing the time necessary to clean up after a grinding job. Vacuum dust shrouds are commonly used while grinding concrete. It can be appreciated how, without a shroud, a significant amount of concrete dust is spread across a wide area. With a vacuum shroud, very little dust goes uncollected. The use of a vacuum shroud can also protect the tool by preventing dust and debris from entering the motor and gears, thus extending tool life.

Effective vacuum shrouds typically cover the top and entire perimeter of the grinding disc so that most of the dust and debris is captured by the vacuum and the disc is not exposed to the operator. Complete enclosure of the perimeter of the grinding disc, however, prevents the tool operator from grinding into a corner, such as when grinding the edge of a floor adjacent a wall. A dust shroud with an opening on a side of the shroud, while allowing grinding into such a corner, captures dust less effectively than a completely enclosed shroud. It is thus desirable to have a shroud with an opening while grinding into a corner and a completely enclosed shroud while during other times.

Vacuum shrouds for grinders have been made which allow a user to remove a hatch portion of the shroud from the rest of the shroud body to expose a side of the grinding disc and allow grinding into a corner. It has been found, however, that workers tend to remove the hatch to grind into a corner and often either lose the hatch or simply neglect to replace the hatch after finishing the corner. Workers will often leave the hatch off of the shroud to save the time required to remove and replace the hatch. A worker needs both hands for operating the grinder, and thus can not hold the hatch while grinding. It is thus not uncommon for workers to simply place the hatch in a toolbox or on the floor, and lose the hatch or simply not replace the hatch as is desired.

Some shrouds have been made with a hatch that is attached to the shroud with a hinge. The hatch folds open when desired. These hatches, however, do not stay open well. The hatches often close during use when the hatch catches on something in the workplace or simply closes due to the vibration of the grinder. These hatches thus become an inconvenience to the operator and may even pose a safety hazard if the hatch interferes with the use of the grinder.

The failure to replace the hatch when not grinding a corner is more detrimental than one might think. In addition to the danger of having an exposed grinding disc, having an opening in the perimeter of the dust shroud allows a significant portion of the grinding dust to escape and not be collected by the vacuum. The dust from grinding concrete is very fine, and will float in the air for a long period of time, allowing uncollected dust to settle over a large area. Additionally, the dust contains compounds from the concrete which are harmful to the lungs, and uncollected dust poses more of a health risk to the worker and to others.

Thus there is a need for a grinder dust shroud with a corner grinding hatch which better encourages workers to use the hatch. There is a need for a grinder dust shroud with an access hatch which is attached to the shroud itself so that the hatch can not be removed from the shroud and lost. There is a need for a hatch design which is easily opened and closed while still remaining effective in capturing dust and while still protecting a worker from the grinding disc and the grinding debris.

SUMMARY OF THE INVENTION

It is an object of the present invention to provide an improved dust shroud for an angle grinder.

According to one aspect of the invention, a dust shroud is provided which includes a slideable access hatch. The access hatch slides around the perimeter of the shroud to expose a portion of the grinding disc and allow grinding into a corner. Because the hatch is not removable from the shroud, it is unlikely that the hatch is lost. The shroud increases worker compliance in properly using the hatch (i.e. closing the hatch when not grinding into a corner) because the hatch is easy to use and does not require the worker to put down the grinder and find/use a separate hatch.

These and other aspects of the present invention are realized in a dust shroud as shown and described in the following figures and related description.

BRIEF DESCRIPTION OF THE DRAWINGS

Various embodiments of the present invention are shown and described in reference to the numbered drawings wherein.

Figure 1:
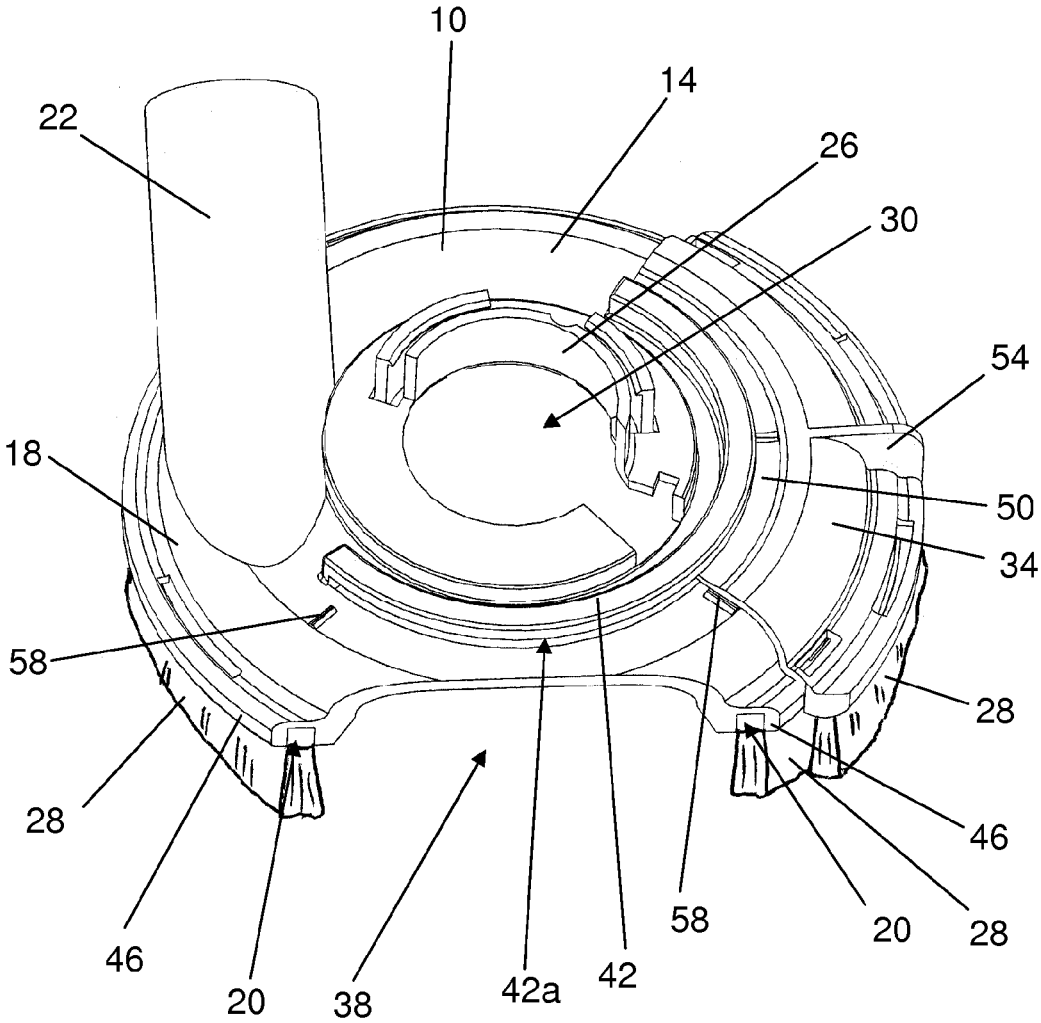
FIG. 1 shows a top perspective view of a shroud of the present invention.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention. For clarity, not all figures show all reference numerals.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Turning now to FIG. 1, a dust shroud 10 for an angle grinder is shown. The dust shroud 10 includes a generally flat upper surface 14 and a skirt 18 that enclose a grinding disc. A vacuum port 22 is attached to the shroud 10 and is open to the interior of the shroud. The vacuum port 22 preferably connects to a standard vacuum hose. The dust shroud 10 includes a mounting collar 26 which surrounds an opening 30 and which is designed to attach to the collar surrounding the output shaft of an angle grinder. The collar 26 may be a universal fit collar or may be designed to work specifically with a single angle grinder. The output shaft of an angle grinder is passed through the opening 30, allowing the collar 26 to be attached to the angle grinder. A grinding disc is then attached to the angle grinder and the grinding disc is generally enclosed within the shroud 10.

The dust shroud 10 includes an access hatch 34. The access hatch 34 slides around the circumference of the shroud 10 to selectively expose or cover an opening 38 in a side of the skirt 18. The opening 38 exposes an edge portion of a grinding disc and allows a worker to grind into a corner, such as when grinding the surface of a floor against a wall. To accommodate the hatch 34, the shroud 10 includes an upper guide channel 42 and a lower guide 46. The upper guide channel 42 is circular in shape and extends across the top surface 14 of the shroud 10. The upper guide channel 42 has an opening 42*a* on the outward edge thereof, and has an L shaped internal cross section so as to capture a ridge on the inner edge 50 of the hatch 34. The lower guide 46 may be formed as a channel in the bottom of the skirt 18, or may be formed with the edge of the skirt.

Figure 3:
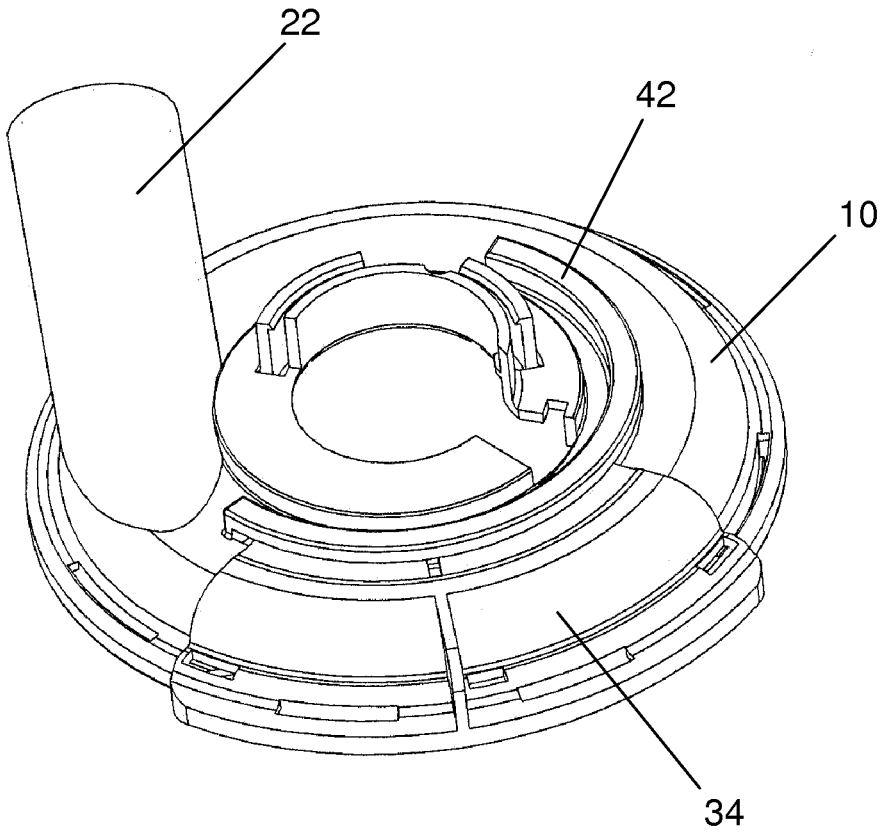
FIG. 3 shows another top perspective view of the shroud of FIG. 1.

The hatch 34 follows the shape of the upper surface 14 and skirt 18 of the shroud so that the shroud 10 maintains an enclosed interior when the hatch is closed. The hatch 34 includes a finger ridge 54 or tab which allows a worker to easily slide the hatch between an open position (as shown) and a closed position (as shown in FIG. 3) without putting their hands near the grinding or cutting blade. The hatch 34 protects the worker's fingers while using the finger tab 54 since the tab is placed near the center of the hatch. Hatches which are attached to the body with a hinge may pose a greater safety risk to the operator as they may be more likely to contact the blade with their fingers while operating the hatch. Additionally, hatches attached with a hinge may move or fall closed during use, interfering with the use of the angle grinder. The upper surface 14 of the shroud has ridges 58 formed thereon which interact with the hatch 34 to hold the hatch in an open or closed position.

Figure 2:
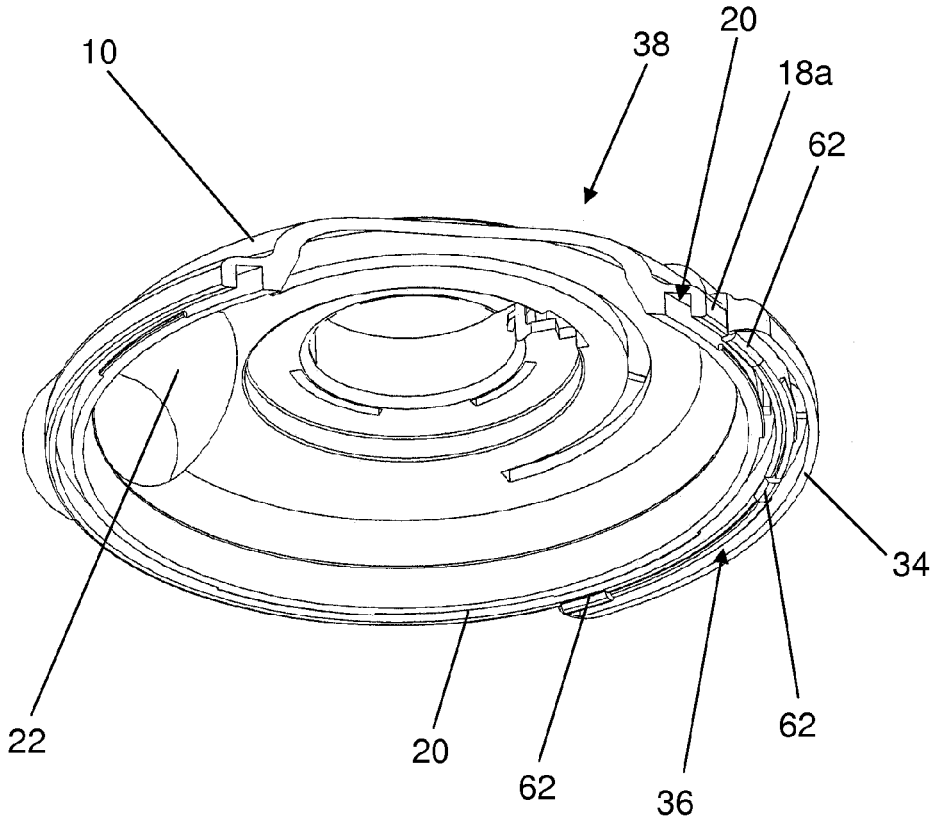
FIG. 2 shows a bottom perspective view of the shroud of FIG. 1.

FIG. 2 shows the bottom of the shroud 10. It can be better seen how the outer edge 18*a* of the skirt forms a guide for the outer portion of the hatch 34. The hatch 34 includes tabs 62 which extend around the skirt edge 18*a* and secure the hatch 34. A slot 20 is formed in the bottom of the outer edge 18*a* of the shroud 10, and a skirt of bristles (28, shown only in FIG. 1 for clarity) may be located in the slot to help capture grinding dust. The outer edge of the hatch 34 as well as the hatch tabs 62 form a C shape which extends around the edge 18*a* of the shroud 10 and secures the hatch without interfering with a bristle skirt if such is used. Similarly, the hatch 34 may have a slot 36 formed in the bottom of the hatch edge to receive a section of bristle skirt 28. The shroud 10 thus allows a bristle skirt to be used without the skirt and the hatch interfering with each other.

Figure 4:
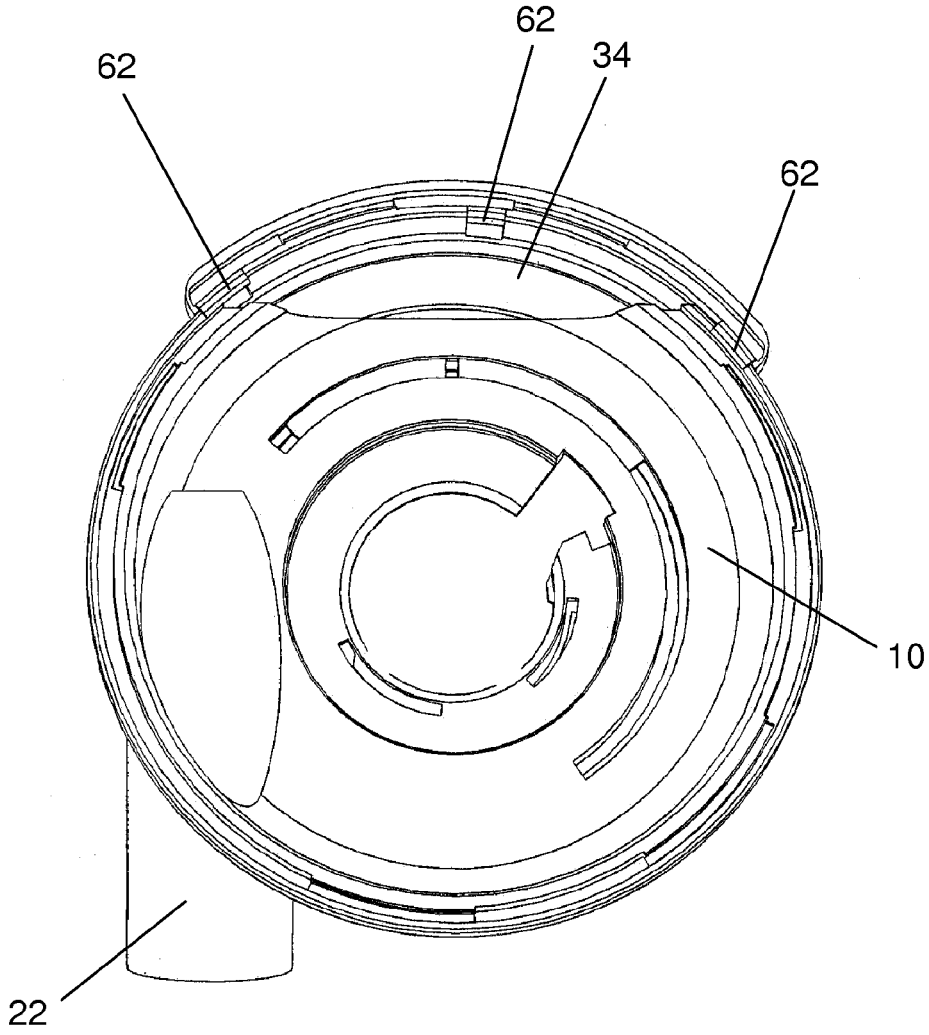
FIG. 4 shows another bottom perspective view of the shroud of FIG. 1.

FIGS. 3 and 4 show the shroud 10 with the hatch 34 in a closed position. It can be seen how the hatch 34 maintains the circular shape of the shroud 10 and does not interfere with the normal use of the shroud. The upper guide 42 has closed ends which, in addition to the ridges 58, keep the hatch 34 in the proper open or closed position and prevent the hatch from moving past the intended open and closed positions.

Figure 5:
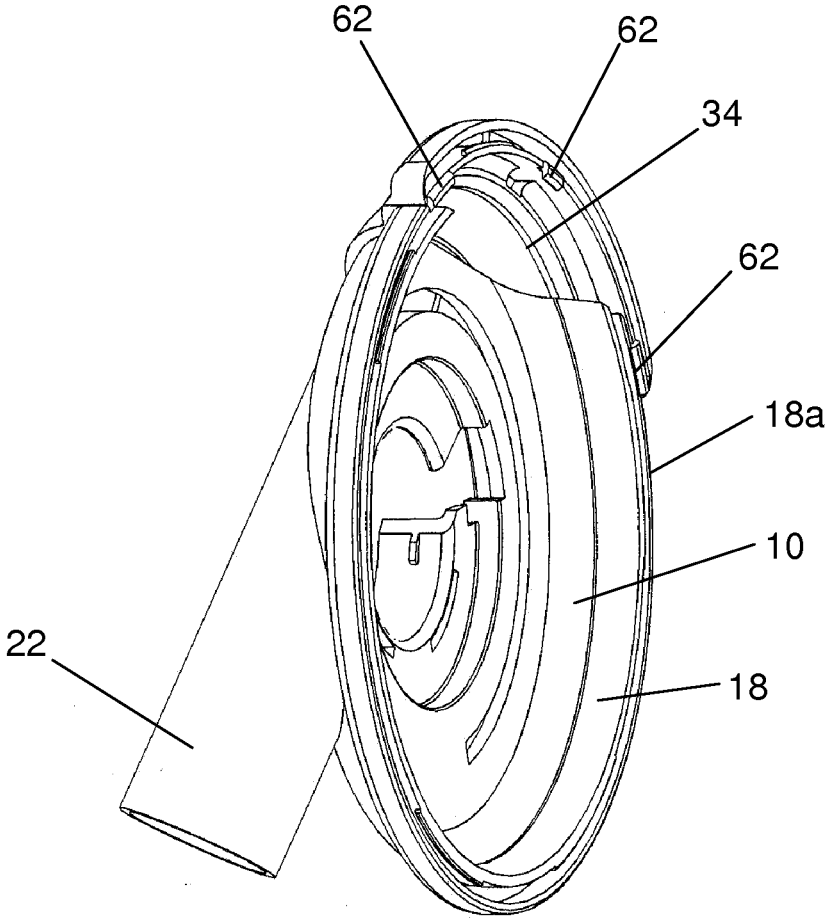
FIG. 5 shows a side perspective view of the shroud of FIG. 1.
Figure 6:
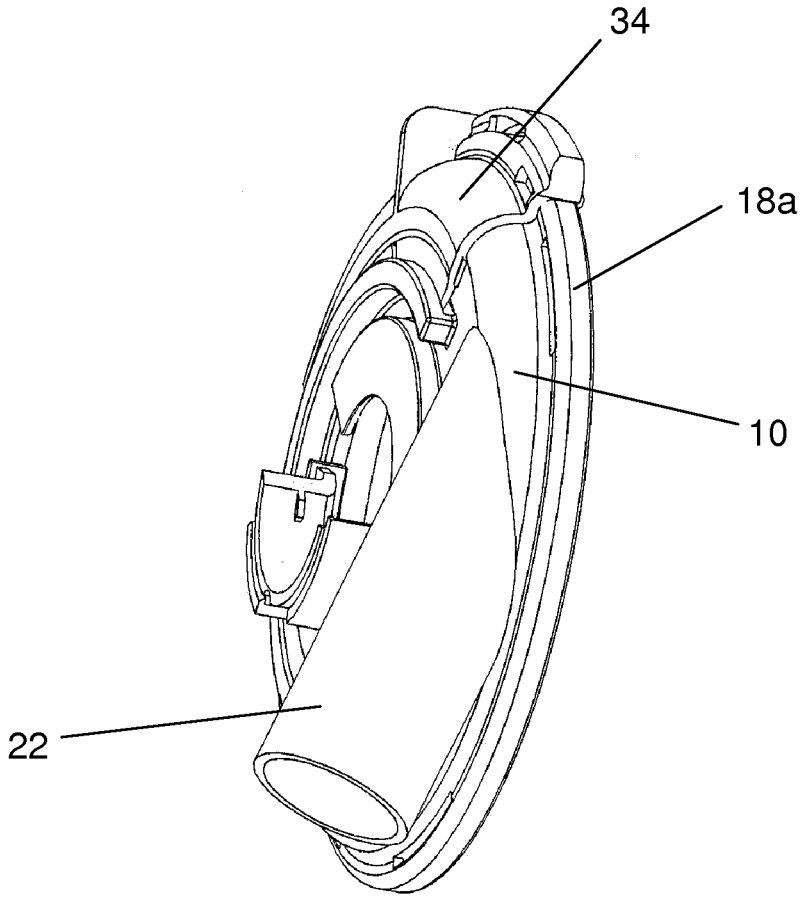
FIG. 6 shows another side perspective view of the shroud of FIG. 1.

FIGS. 5 and 6 show side perspective views of the shroud 10, and better illustrate some of the details of the shroud. The shape of the tabs 62 is better seen, allowing a better understanding of how the hatch 34 engages the edge 18*a* of the skirt 18. The shape and design of the upper guide 42 is also better seen. The upper guide 42 may form a guide channel that extends inwardly towards the center of the shroud 10 and then down through the upper surface of the shroud body in an L shape. This L shaped channel retains the top of the shroud 34. The guide channel also forms an air inlet into the top of the shroud, aiding in the collection of debris and in cooling the grinder motor and bearings.

The shroud 10 provides several benefits. By providing a slideable hatch 34, the shroud 10 allows a worker to more easily open and close the hatch to expose a portion of the grinding disc for grinding into a corner. The finger tab 54, placed near the center of the hatch 34, allows a user to open and close the hatch more safely. Because the hatch 34 is integrally connected to the shroud body, the hatch is not easily lost or set aside like prior art hatches. As the shroud 10 provides a hatch 34 which is always connected to the shroud and easily and quickly used, worker compliance is improved. Workers are more likely to close the hatch 34 after grinding into a corner because there is not any inconvenience or time loss to do so. Increased worker compliance results in a cleaner working environment, reduced health risks, and prolonged tool life.

There is thus disclosed an improved dust shroud for angle grinders. It will be appreciated that numerous changes may be made to the present invention without departing from the scope of the claims.

What is claimed is:

1. A dust shroud for an angle grinder comprising:

a shroud body configured to enclose a grinding disc;

a vacuum port attached to the shroud body to draw air from inside of the shroud body;

a mounting mechanism for attaching the shroud body to an angle grinder;

an access hatch on the shroud body, the access hatch being slideably attached to the shroud body so as to allow the hatch to slide from a closed position to an open position while remaining attached to the shroud body, wherein the access hatch is configured for movement to the open position to expose a side of a grinding disc;

wherein the shroud body is circular in shape, and wherein the access hatch slides along the circumference of the shroud body; and further comprising an upper guide disposed on the top of the shroud body and a lower guide disposed along a skirt which extends downwardly from the top of the shroud body, and wherein the hatch slides along the upper guide and the lower guide to move in a circular direction around the shroud body.

2. The dust shroud of claim 1, wherein the shroud body comprises a generally flat upper surface and a skirt extending downwardly therefrom.

3. The dust shroud of claim 1, wherein the upper guide defines a guide channel and wherein the access hatch has a portion extending into the guide channel and being captively held therein such that the access hatch can slide around the shroud body.

4. The dust shroud of claim 3, wherein the shroud body has stops formed thereon for selectively holding the access hatch in an open position or a closed position.

5. The dust shroud of claim 1, wherein the shroud body has bristles extending downwardly from an outer edge thereof and wherein the access hatch has bristles extending downwardly from an outer edge thereof, and wherein the access hatch is selectively closeable such that the bristles form a circle and wherein the access hatch is selectively openable such that the bristles form a portion of a circle having an opening therein.

6. A dust shroud for an angle grinder comprising:

a generally circular shroud body having an upper surface and a skirt extending downwardly therefrom so as to generally enclose a grinding disc, the shroud body having a side opening on a side thereof, the side opening being configured to allow a portion of a grinding disc to extend through the side opening;

a center opening in the center of the shroud body for receiving the output shaft of an angle grinder;

a mount adjacent the opening for attachment to the angle grinder;

an access hatch slidably attached to the shroud body adjacent an outer perimeter of the shroud body to slide circumferentially around the outside of the shroud body, the access hatch being slidable between an open position wherein the access hatch does not substantially cover the side opening and a closed position wherein the access hatch covers the side opening.

7. The dust shroud of claim 6, further comprising a vacuum port connected to the shroud body to draw air from around the grinding disc.

8. The dust shroud of claim 6, wherein the shroud body has bristles extending downwardly from the perimeter thereof.

9. The dust shroud of claim 6, wherein the shroud body has an upper guide channel disposed adjacent the skirt formed thereon, and wherein the access hatch is slidably received in the upper guide channel to control the movement thereof.

10. The dust shroud of claim 9, wherein the access hatch engages the lower perimeter of the shroud body.

11. The dust shroud of claim 6, wherein the shroud body has stops to limit the motion of the access hatch.

12. A dust shroud for an angle grinder comprising:

a generally circular shroud body configured to enclose a grinding disc, the shroud body having an upper surface and an outer skirt extending downwardly from the upper surface;

an opening formed in the skirt;

a mounting mechanism for attaching the shroud body to an angle grinder;

an access hatch slidably attached to the skirt and movable circumferentially around the outside of the shroud body between an open position where the access hatch does not cover the opening and a closed position where the access hatch covers the opening.

13. The dust shroud of claim 12, wherein the shroud body has an upper guide channel disposed adjacent the skirt, and wherein the access hatch is slidably received in the upper guide channel to control the movement thereof.

14. The dust shroud of claim 12, wherein the access hatch engages a lower perimeter of the skirt.

15. The dust shroud of claim 12, wherein the shroud body has a curved upper guide channel disposed adjacent the skirt and wherein the access hatch has a portion extending into the guide channel and being captively held therein such that the access hatch can slide around the shroud body.

16. The dust shroud of claim 12, further comprising an upper guide disposed adjacent the top of the skirt and a lower guide disposed along the skirt, and wherein the hatch slides along the upper guide and the lower guide.

17. The dust shroud of claim 12, wherein the shroud body has stops formed thereon for selectively holding the access hatch in an open position or a closed position.

18. The dust shroud of claim 12, wherein the shroud body has bristles extending downwardly from a perimeter thereof.

19. The dust shroud of claim 12, further comprising a vacuum port attached to the shroud body to draw air from inside of the shroud body.

* * * * *